United States Patent [19]

Kiso

[11] Patent Number: 4,913,787

[45] Date of Patent: Apr. 3, 1990

[54] GOLD PLATING BATH AND METHOD

[75] Inventor: Masayuki Kiso, Tokyo, Japan

[73] Assignee: C. Uyemura & Co., Ltd., Osaka, Japan

[21] Appl. No.: 408,905

[22] Filed: Sep. 6, 1989

[30] Foreign Application Priority Data

Sep. 6, 1988 [JP] Japan ..... 63-222962

[51] Int. Cl.[4] ..... C25D 3/48; C25D 3/62; C23C 18/44

[52] U.S. Cl. ..... 204/44.3; 204/47.5; 106/1.23; 106/1.26; 427/437

[58] Field of Search ..... 204/47.5, 44.3; 106/1.13, 1.18, 1.23, 1.26; 427/437

[56] References Cited

U.S. PATENT DOCUMENTS 3,506,462 4/1970 Oda et al. ..... 427/437

FOREIGN PATENT DOCUMENTS 1684 1/1972 Japan .
24129 2/1977 Japan .

*Primary Examiner*—G. L. Kaplan
*Attorney, Agent, or Firm*—Birch, Stewart, Kolasch & Birch

[57] ABSTRACT

A gold plating bath having potassium aurous cyanide and thiourea complexing agent dissolved in water and adjusted to an acidity of pH 3 or lower can be used as either electroplating or electroless plating bath. Bright gold electroplating is possible when a brightener is added to the bath. Electroless plating is possible when a reducing agent, typically sodium hypophosphite is added to the bath.

9 Claims, No Drawings

GOLD PLATING BATH AND METHOD

This invention relates to acidic gold plating baths, more particularly, to acidic gold electroplating and electroless plating baths. It also relates to gold plating methods, more particularly, to gold electroplating and electroless plating methods.

BACKGROUND OF THE INVENTION

Gold plating is often applied to electronic parts and many other articles. Most gold plating is partial plating of selected areas of an article following masking of the remaining areas where no plating is necessary. Such partial plating requires a high precision of masking particularly in plating of electronic parts. A variety of masking agents and methods have been developed to meet such requirements. Since masking agents are generally less resistant to alkali, plating in an alkaline bath sometimes causes the masking film to separate from the underlying substrate. On the other hand, electronic parts now use a variety of substrates, some of which are less resistant to alkali. There is a need for an acidic bath for partial plating purposes.

Most prior art gold plating baths use gold compounds in the form of cyanides. Although cyanides, halides, sulfites, and thiosulfates are known as water soluble gold compounds, the gold source for gold plating bath is most often gold cyanides because of their shelf stability. The gold cyanides include potassium aurous cyanide or gold(I) cyanide and potassium auric cyanide or gold(III) cyanide. Potassium aurous cyanide is most often used in the current gold plating bath.

The plating bath using potassium aurous cyanide becomes ineffective at an acidity of pH 3 or lower because potassium aurous cyanide decomposes into AuCN, that is, becomes insoluble in water. Thus the potassium aurous cyanide plating bath is formulated as weakly acidic type with at least pH 4, neutral type and alkaline type, but not applicable to strongly acidic bath of pH 3 or lower.

In contrast, potassium auric cyanide is stable at an acidity of pH 3 or lower and used in some plating baths. However, such plating baths are not widespread because of their preparation cost.

SUMMARY OF THE INVENTION

Therefore, an object of the present invention is to provide a gold plating bath which uses potassium aurous cyanide, which is more cost effective than potassium auric cyanide, and is stable at pH 3 or lower.

Another object of the invention is to provide a gold plating method using such a bath.

We have discovered that when thiourea is added to a gold plating bath using potassium aurous cyanide, the potassium aurous cyanide is stabilized even at an acidity of pH 3 or lower and thus prevented from decomposing into water-insoluble AuCN. Then a satisfactory gold film can be deposited from a strongly acidic bath of pH 3 or lower. More particularly, an electroplated gold film is obtained by immersing an article in the bath, with the article made cathode, and applying electricity between the cathode and the anode. An electroplated gold film having a bright finish is obtained, that is, bright gold plating becomes possible when a water soluble salt of nickel, cobalt, iron or indium is added to the bath. Electroless or chemical gold plating becomes possible when a reducing agent such as sodium hypophosphite and hydrazine is added to the bath.

According to a first aspect of the present invention, there is provided a gold electroplating bath comprising potassium aurous cyanide and thiourea complexing agent in water, with a pH of up to 3. The bath may further include a brightener in the form of a water soluble salt of a metal selected from the group consisting of nickel, cobalt, iron and indium.

Gold may be electroplated on an article in a bath as defined above.

According to a second aspect of the present invention, there is provided a gold electroless plating bath comprising potassium aurous cyanide, thiourea complexing agent, and a reducing agent in water, with a pH of up to 3.

Gold may be chemically plated on an article in a bath as defined above.

DETAILED DESCRIPTION OF THE INVENTION

The gold plating bath of the present invention uses potassium aurous cyanide as the gold source and has thiourea complexing agent added thereto while the pH of the bath is 3 or lower.

The concentration of potassium aurous cyanide in the bath is preferably in the range of from 0.7 to 30 gram/liter, more preferably from 1.5 to 15 gram/liter. The thiourea is preferably present in a concentration of from 0.1 to 200 gram/liter, more preferably from 1 to 50 gram/liter. Acid is generally added so as to adjust the bath to pH 3 or lower. The type of acid is not critical although sulfuric acid, phosphoric acid, pyrophosphoric acid, hydrochloric acid, perchloric acid, sulfamic acid, methane sulfonic acid, and organic carboxylic acids and a mixture of two or more of them may preferably be used. The most preferred acid is pyrophosphoric acid. The acid is added in such an amount as to adjust the bath to pH 3 or lower, preferably pH 0.5 to 2.

The bath of the invention is based on the above-described formulation and may be used as either an electro-plating bath or an electroless plating bath.

When the basic formulation is used for electroplating, a bath of the above formulation may be used as such. When it is desired to form a bright gold plating film, a brightener may be added to the bath. Examples of the brightener include water-soluble salts of nickel, cobalt, iron and indium, more particularly sulfate, hydrochloride and phosphate salts of such metals and they may be added alone or in admixture of two or more. The most preferred brightener is cobalt sulfate. The brightener may be added in any desired amounts, preferably in a concentration of 1 to 1,000 mg/liter, more preferably 100 to 500 mg/liter of elemental metal.

This gold electroplating bath allows electroplating to be carried out by any well known methods. With an article or workpiece made cathode, electricity may be conducted between the cathode and the anode to perform electroplating. Preferably, plating is carried out at a cathodic current density of 0.1 to 5 A/dm$^2$, more preferably 0.5 to 2 A/dm$^2$ and a bath temperature of 25° to 60° C., more preferably 30° to 40° C. The anode may be of platinum or platinum plated titanium. Agitation of the bath may be by rocking agitation or mechanical stirring.

When the basic formulation defined above is used as an electroless or chemical plating bath, a reducing agent is added to the bath. Examples of the reducing agent include hypophosphorous acid, hypophosphites such as sodium hypophosphite, hydrazine, and hydrazine compounds such as hydrazine hydrochloride and hydrazine sulfate, with the hypophosphorous acid and hypophosphites being most preferred. The reducing agent may be added in any desired amounts, preferably in a concentration of 0.1 to 100 gram/liter, more preferably 3 to 20 gram/liter.

It is desired to further add a promoter to the electroless plating bath. Examples of the promoter include salts of thallium, lead and tin which are soluble in the bath, for example, chlorides, carboxylates, and sulfates thereof. Lead acetate is most preferred. The promoter may also be added in any desired amounts, preferably in a concentration of 0.1 to 100 mg/liter, more preferably 0.5 to 50 mg/liter calculated as elemental metal.

The concentration of potassium aurous cyanide in the electroless plating bath is preferably in the range of 0.7 to 30 gram/liter, more preferably 1.5 to 15 gram/liter as previously described. Most often the concentration is in the range of 0.7 to 12 gram/liter, especially 1.5 to 7.5 gram/liter for electroless plating.

Since the gold electroless plating bath of the invention is reactive to gold only, it is necessary to previously deposit catalytic gold on an article by a dry process such as ion plating or a wet process such as immersion plating. The plating temperature is preferably in the range of 50° to 100° C., more preferably 60° to 80° C.

EXAMPLE

Examples of the invention are given below by way of illustration and not by way of limitation.

Example 1

A gold electroplating bath of the following formulation was prepared.

Pyrophosphoric acid: 80 g/l
Thiourea: 30 g/l
Cobalt sulfate: 1.4 g/l
Potassium aurous cyanide: 5.9 g/l (4 g/l of Au) pH 0.8

Using the bath, electroplating of gold was carried out on an article in the form of a nickel plated copper plate having a size of 1 $dm^2$ per liter of the solution. The plating conditions are given below.

Cathodic current density: 2 $A/dm^2$.
Bath temperature: 40° C.
Agitation: Rocking agitation
Anode: Platinum plated titanium plate When plating was carried out in the bath of the above formulation under the above-mentioned conditions, gold deposited at a rate of 0.2 μm per minute. There was deposited a gold film having a satisfactory bright finish.

After the bath of the above formulation was allowed to stand for 7 days at 70° C., no precipitate settled, indicating that potassium aurous cyanide remained stable. A gold plating bath of the same formulation as above except that thiourea was omitted could not be used as plating bath when heated to the elevated temperature because AuCN precipitated immediately.

Example 2

A gold electroless plating bath of the following formulation was prepared.

Pyrophosphoric acid: 80 g/l
Thiourea: 30 g/l
Sodium hypophosphite: 10 g/l
Potassium aurous cyanide: 4.4 g/l (3 g/l of Au)
Lead acetate: 10 mg/l pH 0.8

Electroless plating of gold was carried out on an article in the bath of the above formulation at a temperature of 65° C. The article was a copper plate having a size of 0.8 $dm^2$ per liter of the plating solution, which had been subjected to nickel plating and then to immersion gold plating.

Gold deposited at a rate of about 1 μm per hour. There was obtained a gold film having an even lemon yellow appearance.

No precipitate was noticed after the bath of the above formulation was allowed to stand for one day at 90° C.

Despite strong acidity of pH 3 or lower, the gold plating bath of the invention allows potassium aurous cyanide to remain stable and causes no precipitation of AuCN. The present invention enables effective use of potassium aurous cyanide in strongly acidic plating bath. Satisfactory gold coatings can be deposited from the bath of the invention.

Although some preferred embodiments have been described, many modifications and variations may be made thereto in the light of the above teachings. It is therefore to be understood that within the scope of the appended claims, the invention may be practiced otherwise than as specifically described.

I claim:

1. A gold electroplating bath comprising potassium aurous cyanide and thiourea complexing agent and having a pH of up to 3.

2. The bath of claim 1 which contains
0.7 to 30 gram/liter of potassium aurous cyanide, and
0.1 to 200 gram/liter of thiourea.

3. The bath of claim 1 which further comprises a brightener in the form of a water soluble salt of a metal selected from the group consisting of nickel, cobalt, iron and indium.

4. The bath of claim 3 which contains
0.7 to 30 gram/liter of potassium aurous cyanide,
0.1 t 200 gram/liter of thiourea, and
1 to 1,000 mg/liter of the metal salt brightener calculated as elemental metal.

5. A gold electroplating method comprising electroplating gold on an article in a bath as set forth in claim 1 or 3.

6. A gold electroless plating bath comprising potassium aurous cyanide, thiourea complexing agent, and a reducing agent and having a pH of up to 3.

7. The bath of claim 6 wherein said reducing agent is selected from the group consisting of hypophosphorous acid, hypophosphites, hydrazine, and hydrazine derivatives.

8. The bath of claim 7 which contains
0.7 to 30 gram/liter of potassium aurous cyanide,
0.1 to 200 gram/liter of thiourea, and
0.1 to 100 gram/liter of the reducing agent.

9. A gold electroless plating method comprising chemically plating gold on an article in a bath as set forth in claim 6.

* * * * *